US007654869B2

(12) United States Patent
Ting

(10) Patent No.: US 7,654,869 B2
(45) Date of Patent: Feb. 2, 2010

(54) CARD CONNECTOR

(75) Inventor: Chien-Jen Ting, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/287,464

(22) Filed: Oct. 8, 2008

(65) Prior Publication Data

US 2009/0093141 A1 Apr. 9, 2009

(30) Foreign Application Priority Data

Oct. 8, 2007 (TW) ..... 96137648 A

(51) Int. Cl.
*H01R 24/00* (2006.01)

(52) U.S. Cl. ..... 439/630; 439/541.5; 439/638; 439/159

(58) Field of Classification Search ..... 439/157, 439/159, 541.5, 630, 638
See application file for complete search history.

(56) References Cited

U.S. PATENT DOCUMENTS

| | | | | |
|---|---|---|---|---|
| 5,713,747 | A | 2/1998 | Hsia | |
| 7,086,895 | B1 * | 8/2006 | Ting | 439/541.5 |
| 7,189,088 | B2 | 3/2007 | Cheng | |
| 7,252,544 | B2 * | 8/2007 | Wada et al. | 439/573 |

* cited by examiner

*Primary Examiner*—Truc T Nguyen
(74) *Attorney, Agent, or Firm*—Andrew C. Cheng; Wei Te Chung; Ming Chieh Chang

(57) ABSTRACT

A card connector (100) for connecting with an electronic element, includes a first connector (30) comprising a first insulating housing (50) retaining a plurality of first terminals (51) and a first cavity (20) for receiving a first card; a second connector (40) stacked with the first connector and comprising a second insulating housing (60) retaining a plurality of second terminals (131) and a second cavity (80) for receiving a second card; a printed circuit board (10) sandwiched by the first connector and the second connector, the first terminals and the second terminals set on opposite sides of the circuit board; and a third connector (14) mounted on the printed circuit board for connecting the first connector and the second connector with the electronic element electrically.

15 Claims, 7 Drawing Sheets

CARD CONNECTOR

BACKGROUND OF THE INVENTION

1. Field of the Invention

The present invention relates to a card connector, and particularly to a card connector which includes a plurality of terminals set on a circuit board.

2. Description of Prior Arts

Memory cards are known in the art and contain intelligence in the form of a memory circuit or other electronic program. Some form of card reader reads the information or memory stored on the card. Memory cards are used in many applications in today's electronic society, including video cameras, smart-phones, music players, ATMs, cable television decoders, toys, games, PC adapters and other electronic applications. A typical memory card includes a contact or terminal array for connection through an electrical connector to a card reader system and then to external equipment. The connector readily accommodates insertion and removal of the card to provide quick access to the information and program on the card. The card connector includes terminals for yieldably engaging the contact or terminal array of the card.

Rapid progress in various electronic applications and improvements in shrinking-size components may make mini card connector most popular used in the electronic applications in the future. A conventional card connector is usually installed on a main board by connecting with a third connector mounted on the main board in advance. Example is disclosed in U.S. Pat. No. 5,713,747. Such card connector mainly has a first memory card connector, a second memory card connector positioned in stacked parallel relation to said first memory card connector. Each memory card connector comprises a header which is provided with a plurality of pins. A lower and a higher vertical printed circuit board are electrically connected to corresponding pins of each header. The lower end of each vertical printed circuit board is detachably inserted into a third connector securely mounted on the surface of a main board in advance.

However, in the prior art as described above, the pins must extend a long distance to connect with the lower and the higher vertical circuit board, such manner increasing the overall length of the card connector. Particularly, it is possible for an external device to interfere with the outward pins which are used for connecting with the higher vertical printed circuit board and the lower vertical board. Besides, in such structure, one memory card connector should be mate with one vertical printed circuit board and one third connector, and if more than one memory card connectors are superimposed, there should be more vertical circuit boards and third connectors to mate with. Thus, more space of the main board will be occupied by the circuit boards and third connectors. It is inconvenient and disadvantageous for the development of a mini type card connector, and more particular, for a shrinking-size electronic application.

Therefore, the present invention is directed to solving the problem by providing a card connector which has a mini structure.

SUMMARY OF THE INVENTION

An object, therefore, of the invention is to provide a card connector capable of saving more space on a main board and avoiding an interference to terminals from external device.

In the exemplary embodiment of the invention, a card connector for connecting with an electronic element, includes a first connector comprising a first insulating housing retaining a plurality of first terminals and a first cavity for receiving a first card; a second connector stacked with the first connector and comprising a second insulating housing retaining a plurality of second terminals and a second cavity for receiving a second card; a printed circuit board sandwiched by the first connector and the second connector, the first terminals and the second terminals set on opposite sides of the circuit board; and a third connector mounted on the printed circuit board for connecting the first connector and the second connector with the electronic element electrically.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
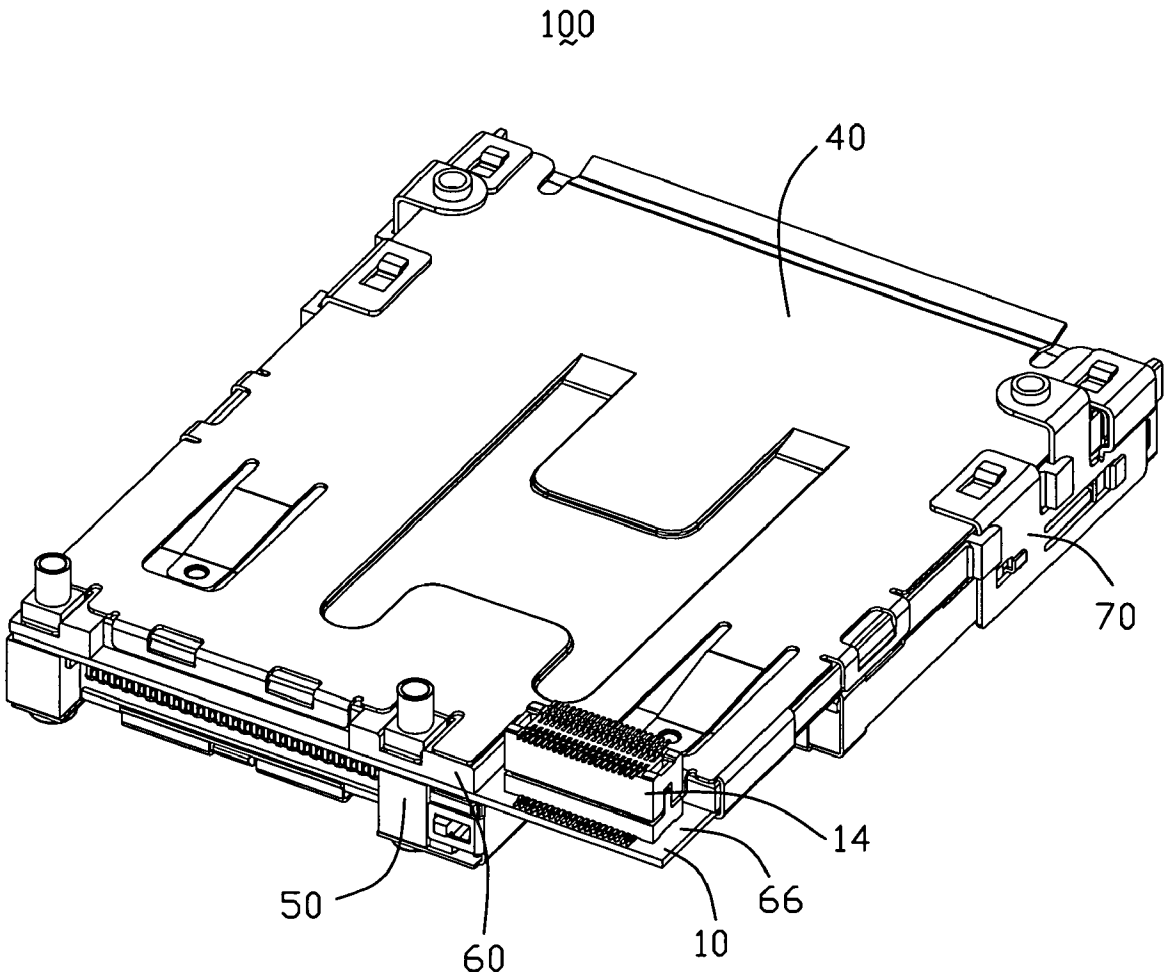
FIG. 1 is a perspective view of a card connector of present invention.

Referring to FIG. 1 to FIG. 7, the present invention provides a card connector 100 comprising a first connector 30 defining a first cavity 20 for accommodating a first card (not shown), a second connector 40 defining a second cavity 80 for accommodating a second card (not shown), a printed circuit board 10 sandwiched by the first connector 30 and the second connector 40, and a female connector 14, for example, a BTB, FPC, FFC, or other cable styles, constituted a third connector 14 in present invention, for connecting the card connector 100 with an electronic element (not shown), such as a maim board electrically. The first card and the second card are different from each other, such as Express card and Smart card, respectively. In this embodiment, the first connector 30 is different from the second connector 40, however they can be the same feature as well to receive the same card. The printed circuit board 10 is provided with a pair of bolt holes 11 for bolts 33, 43 passing through and a pair of holes 12.

Figure 3:
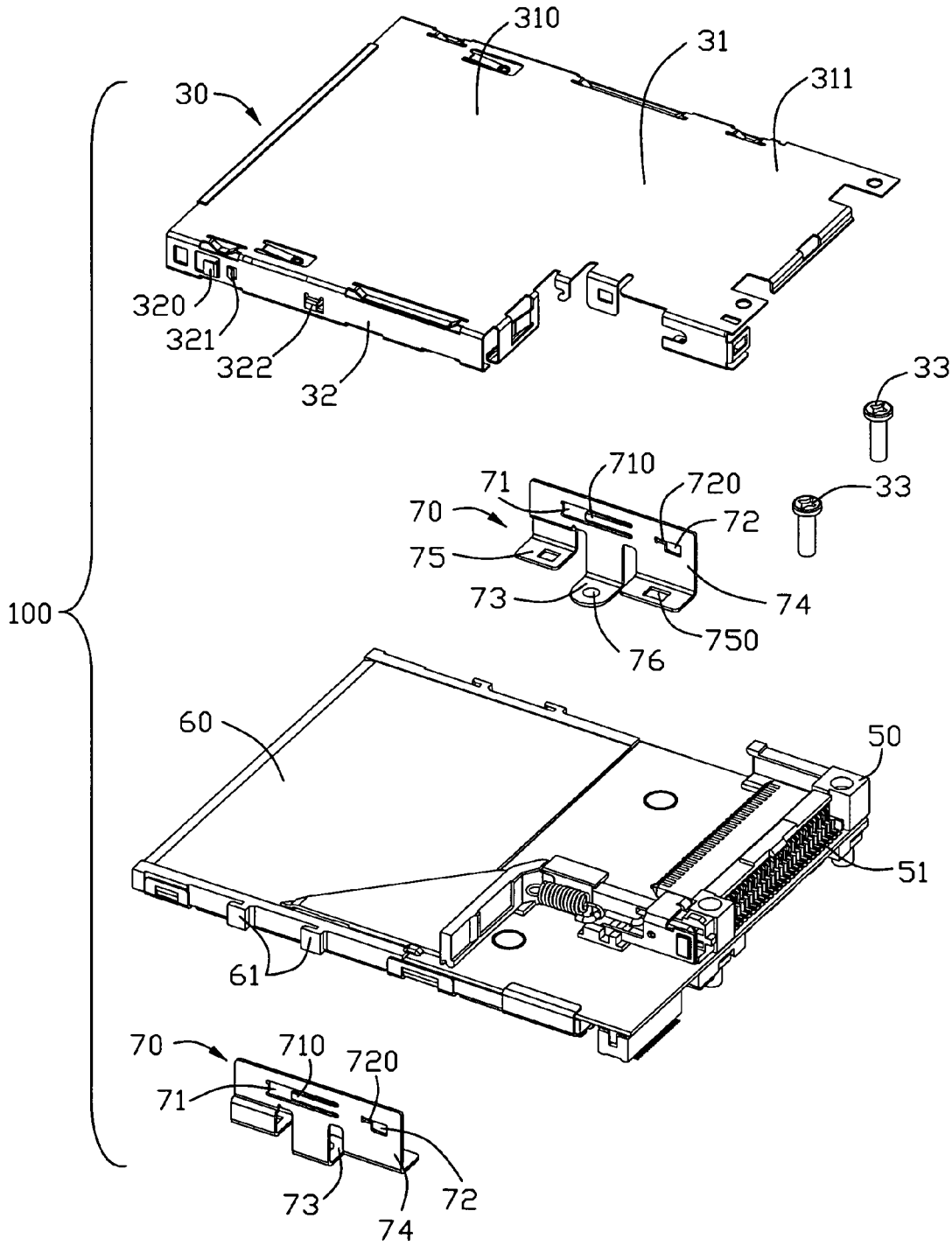
FIG. 3 is a perspective view of a first shell and a pair of stand off of the card connector removed from the card connector of present invention.

Together with FIG. 3 and FIG. 4, the structure of the first connector 30 and the second connector 40 will be described curtly because they have been known as published.

Figure 2:
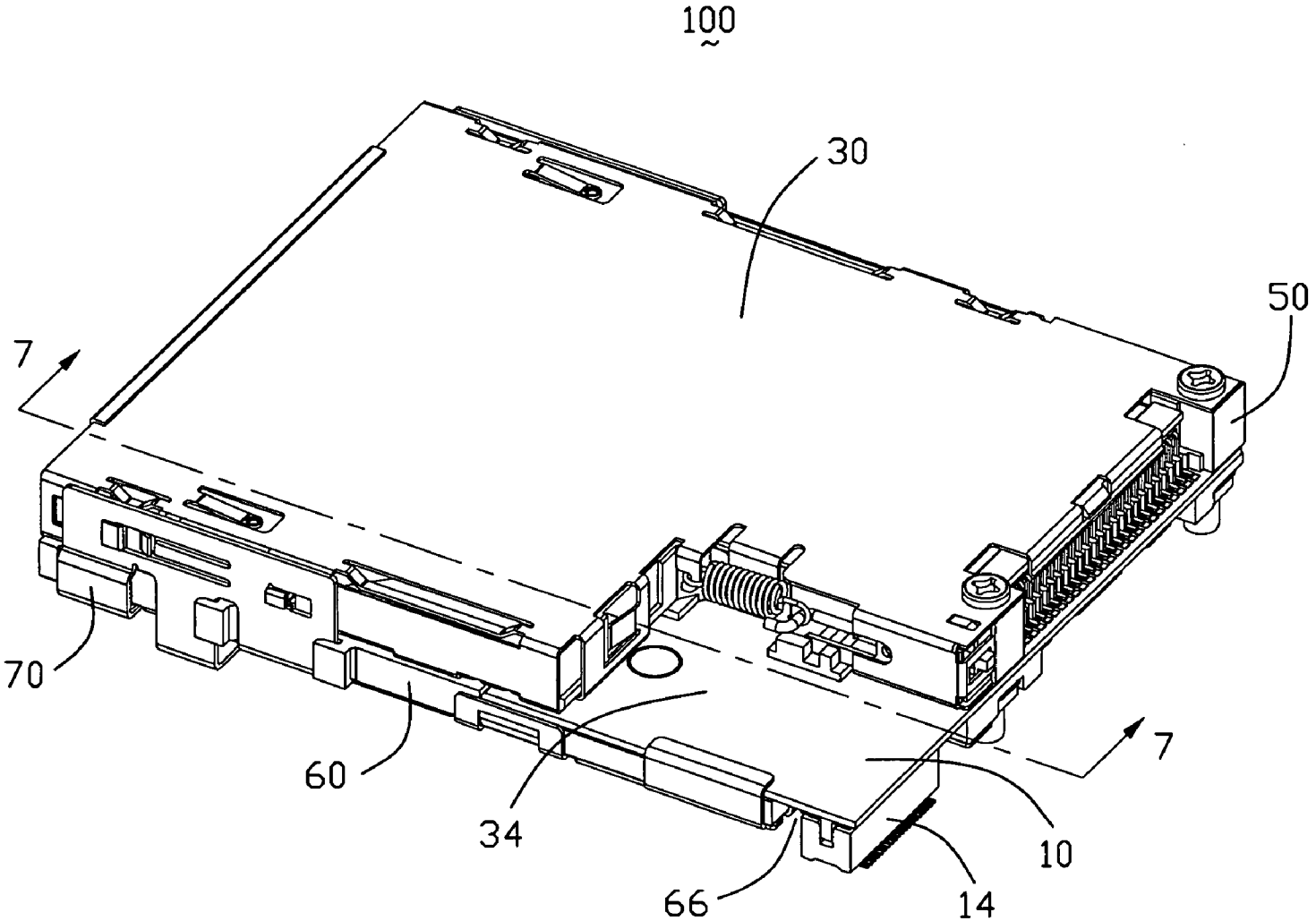
FIG. 2 is a perspective view of the card connector of present invention as shown in FIG. 1 in another aspect.

The first connector 30 comprises a first shell 31 and a first insulating housing 50 covered by the first shell 31. The first insulating housing 50 receives a plurality of first terminals 51 to engage with the first card and mounted on one side of the printed circuit board 10 with the first terminals 51 set thereon in a line. The first shell 31 is of an L shape and defines a first portion 310 with a card entrance and a second portion 311 locking with the first insulating housing 50. The first portion 310 has a width greater than that of the second portion 311 along a transverse direction perpendicular to an inserting direction of the first or second card. Therefore, the first cavity 20 is defined of an L shape to selectively receive an L-shape card or a rectangular shape card. Correspondingly, a first void space 34 is produced at a back corner of the first shell 31 and located at a lateral side of the first insulating housing 50, as shown in FIG. 2. The width of the printed circuit board 10 is approximately corresponding to the width of first portion 310, so the printed circuit board 10 partially protrudes into the first void space 34. In a top view, the first connector combining with the printed circuit board 10 is approximately of a rectangular shape. The wider portion 310 comprises a pair of lateral walls 32, and each later wall 32 has a first locking piece 320 extending forwardly, a second locking piece 321 extending backwardly, and a third locking piece 322 extending downwardly therefrom.

Figure 4:
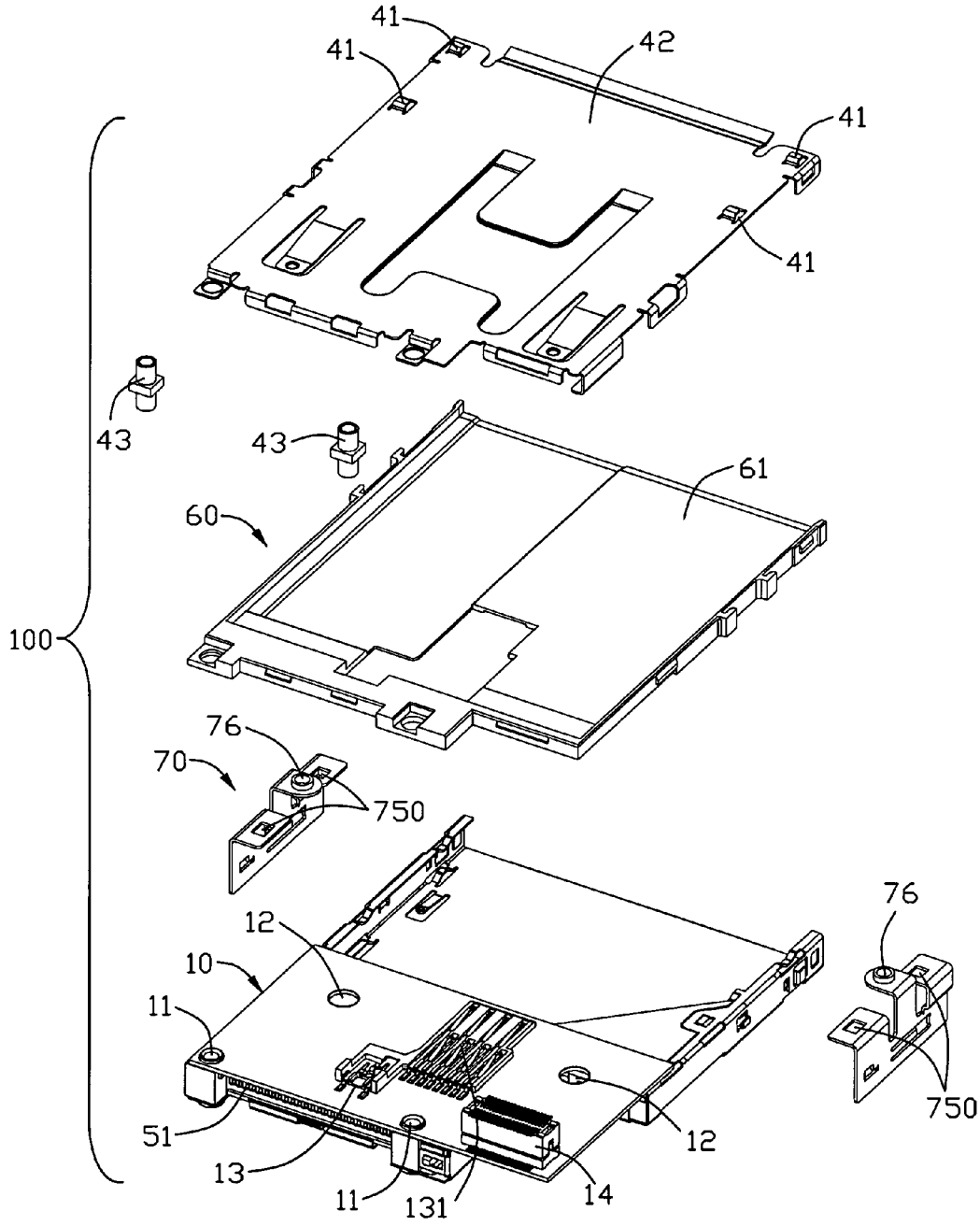
FIG. 4 is a perspective view of a second shell, a second insulating housing and the stand off removed from the card connector of present invention.
Figure 5:
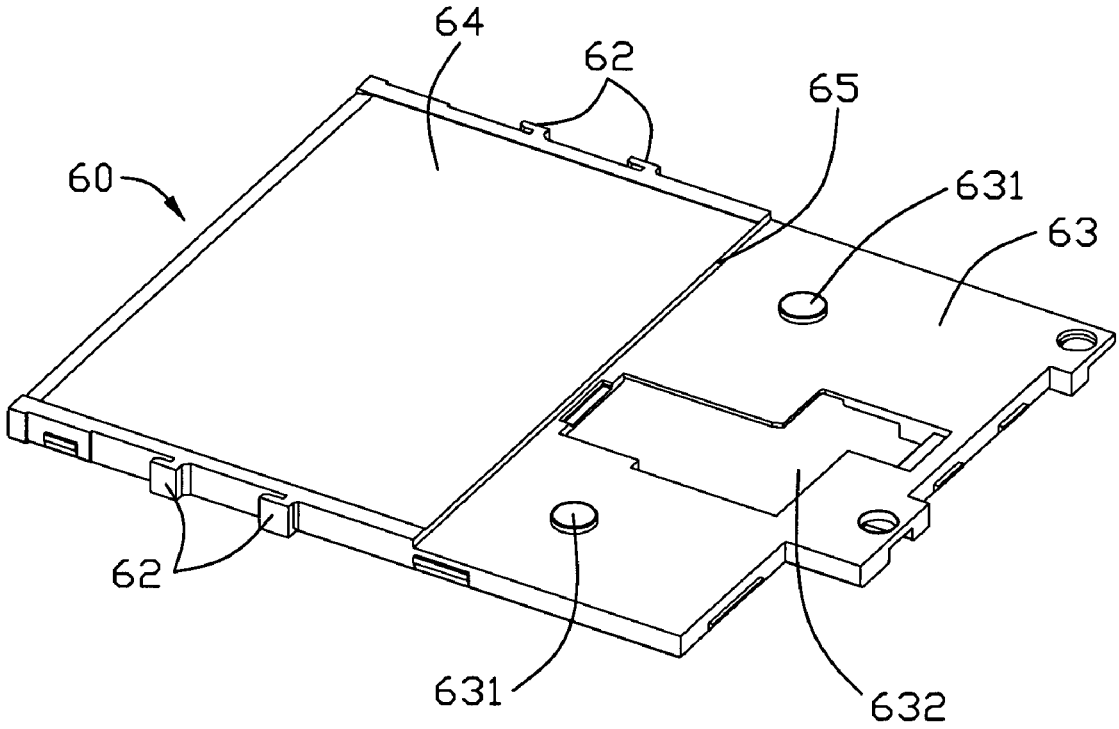
FIG. 5 is a perspective view of the second insulating housing in another aspect respect to the view shown in FIG. 4.
Figure 6:
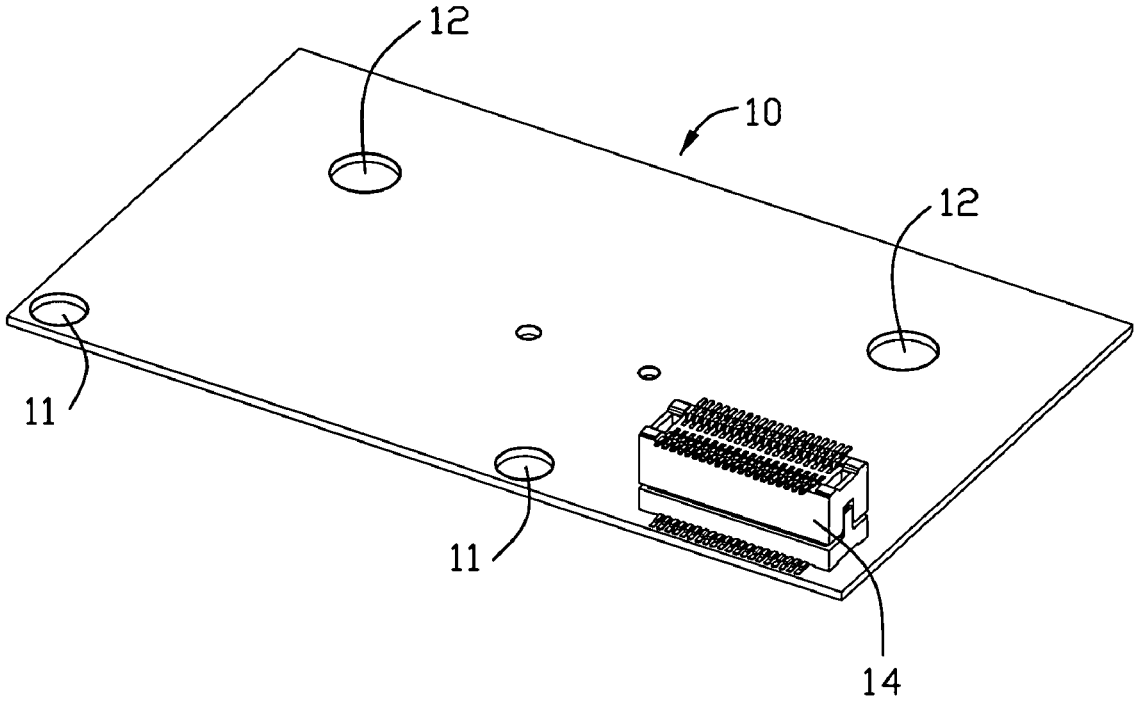
FIG. 6 is a perspective view of a printed circuit board of present invention with a third connector mounted thereon.
Figure 7:
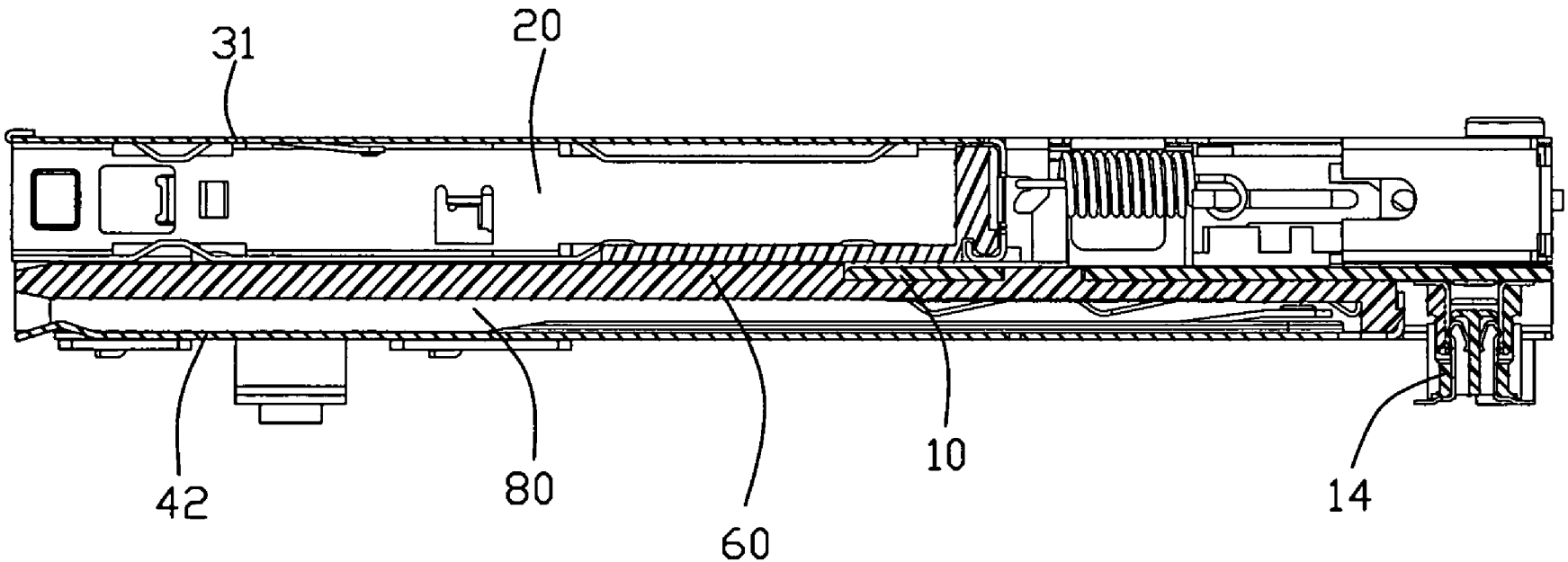
FIG. 7 is a cross section view of the card connector of present invention in FIG. 2 taken along line 7-7.

As shown in FIG. 4 and FIG. 5, the second connector 40 comprises a second shell 42, a second insulating housing 60 covered by the second shell 42, and a terminal module 13 mounted on the printing printed circuit board 10 directly. The terminal module 13 accommodates a plurality of second terminals 131 to electrically engage with the second card. The second insulating housing 60 mainly has two faces, and a first face 61 opposite to the second shell 42 for supporting the second card remove, a second face (not labeled) back to back the first face 61 to lock with the printed circuit board 10. The second face is structured of an upper portion 64 and a lower portion 63, both of them are divided by a step 65. The lower portion 63 is designed to receive the printed circuit board 10. Particularly, the lower portion 63 combining with the printed circuit board 10 has a height equal to that of the upper portion 64. It is to say that when the printing printed circuit board 10 is mounted on the lower portion 63, the upper portion 64 has a surface which is located in a same level or face with an external surface of the printed circuit board 10. So, there is no any interference in the first cavity 20 for the first card remove. Besides, the lower portion 63 comprises a pair of posts 631 to be placed in the holes 12 of the printed circuit board 10, and a receiving hole 632 to couple to the terminal module 13. The second shell 42 comprises a main body (not labeled) covering the second insulating housing 60 and two pairs of clasps 41 on the main body. Each clasp 41 defines an extending direction which is the same as the direction of other clasps. At a back corner of the second connector, a second void space 66 is defined, as shown in FIG. 1. The printed circuit board 10 partially protrudes into the second void space 66. As a result, the overall shape of the second connector 40 is approximately of a rectangular type by combining with the printed circuit board in a top view. As shown in FIG. 1 and FIG. 2, the first void space 34 and the second void space 66 are separated by the printed circuit board 10 at opposite sides thereof.

When the first connector 30 and the second connector 40 are mounted together, the first insulating housing 50 and the terminal module 13 are set to the opposite surfaces of the printed circuit board 10 directly, together with the first terminals 51 and the second terminals 131 soldered on the opposite surfaces of the printed circuit board 10 electrically. Such terminals arranging manner can provide more room for terminals and avoid a high density of terminals on a same face of the printed circuit board 10, achieving a simple and efficient soldering procedure.

To fasten the first connector 30 and the second connector 40 together more firmly, there are a pair of stand off 70 locking with the first shell 31 and the second shell 42. The entire height of the stand off 70 is designed in requirement according to that of the third connector 14 and the card connector 100, in order to make a proper room between the card connector 100 and the main board to set other device or without any room therebetween to reduce the entire height. Each stand off 70 comprises a fixing plate 74 and a standing portion 73 with a mounting hole 76. The standing portion 73 extends downwardly from the fixing plate 74 to engage with the main board. The fixing plate 74 comprises a first hole 72 with a gap 720, a second hole 71 with an elastic piece 710 protruding therein, and a pair of mounting plates 75 extending inwardly from the fixing plate 74. The first shell 31 and the second shell 42 are locked with the stand off 70 in such manner that the first locking piece 320 of the first shell 31 protruding into the second hole 71 properly with the second locking piece 321 collide with the elastic piece 710 rightly to escape from a sidewardly remove, the third piece 322 passes though the first hole 72 and slide in the gap 720 to escape from an upwardly or downwardly remove. Each mounting plate 75 has a locking hole 750 to fasten with the clasp 41 of the second shell 42. Furthermore, each fixing plate 74 is pressed by the pair of clips 62 of the second insulating housing 60 achieving a more table structure.

In this embodiment, the third connector 14 is mounted on the second void space 66 to connect the card connector 100 with the main board electrically. In other embodiment, the third connector 14 also can be set on the first void space 34. With such manner, the third connector 14 is mounted on the printed circuit board 10 without increasing the overall length of the card connector 100. Furthermore, it is unnecessary for the first terminals 51 and the second terminals 131 to extend a long distance to engage with the printed circuit board 10, only soldered on the printed circuit board 10 directly, and no external device capable of interfering them. In present invention, the third connector 14 is mounted on the printed circuit board 10 which is sandwiched by the first connector 30 and the second connector 40. Essentially, the third connector 14 can be used in any card connector which selectively has the first portion 34 or the second portion 66 as described above to place the third connector 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card connector for connecting with an electronic element, comprising:

a first connector comprising a first insulating housing retaining a plurality of first terminals and a first cavity for receiving a first card;

a second connector stacked with the first connector and comprising a second insulating housing retaining a plurality of second terminals and a second cavity for receiving a second card;

a printed circuit board sandwiched by the first connector and the second connector, the first terminals and the second terminals set on opposite sides of the circuit board; and a third connector mounted on the printed circuit board for connecting the first connector and the second connector with the electronic element electrically;

wherein the third connector is located at a back corner of the second connector;

wherein the first insulating housing and the second insulating housing are mounted directly on opposite of the circuit board.

2. The card connector as claimed in claim 1, wherein a void space is defined at a back corner of the second connector, the printed circuit board partially protrudes into the void space, and the third connector is located at the void space.

3. The card connector as claimed in claim 2, wherein the second connector combining with the printed circuit board is approximately of a rectangular shape in a top view.

4. The card connector as claimed in claim 3, wherein the second insulating housing comprises a first face and a second face back to back the first face, and the second face comprises an upper portion and a lower portion receiving the circuit board.

5. The card connector as claimed in claim 4, wherein the lower portion combined with the printed circuit board has a height approximately equal to the height of the upper portion.

6. The card connector as claimed in claim 5, wherein the lower portion comprises a pair of posts, and the printed circuit board comprises a pair of holes in alignment with the posts.

7. The card connector as claimed in claim 1, wherein the first connector comprises a first shell mounted on the first insulating housing, the second connector comprises a second shell mounted on the second insulating housing, and a stand off is provided to lock with first shell and the second shell in common.

8. The card connector as claimed in claim 7, wherein the second shell has a main plate covering the second insulating housing and comprising a clasp, and the stand off has a mounting plate extending inwardly and defining a locking hole coupling to the clasp.

9. The card connector as claimed in claim 8, wherein the first shell comprises a side wall extending downwardly therefrom; the side wall comprises a first locking piece extending forwardly, a second locking piece extending backwardly, and a third piece extending downwardly; the stand off comprises a first hole receiving the third piece, and a second hole with an elastic piece protruding therein; and the first locking piece is retained in the second hole, the second locking piece colliding with the elastic piece.

10. An electrical card connector assembly comprising:

lower and upper connector units stacked with each other, each defining a card receiving cavity therein;

a plurality lower contacts extending within the card receiving cavity of the lower connector unit;

a plurality of upper contacts extending within the card receiving cavity of the upper connector unit; and an intermediate printed circuit board located, in a vertical direction, between said upper connector unit and said lower connector unit, to which said first contacts and said second contacts are connected; wherein the lower connector unit defines a first cutout through which a connection set extends under a condition that an upper end of said connection set is connected to an underside of the intermediate printed circuit board and a lower end of the connection set is connected to a mother board on which the stacked upper and lower connector units are seated;

wherein the electrical card connector assembly further including an insulative plate sandwiched between said upper connector unit and said lower connector to separate the corresponding card receiving cavities under a condition that complementary interengaging devices are formed on the printed circuit board and the insulative plate for assembling;

wherein said connection unit is located at a comer of said printed circuit board, and both said first cutout and said second cutout are located at corresponding comers of said lower connector unit and said upper connector unit.

11. The electrical card connector assembly as claimed in claim 10, wherein said connector assembly further includes a plurality of standoffs to compensate a height of said connection set between the printed circuit board and the mother board.

12. The electrical card connector assembly as claimed in claim 10, wherein said upper connector unit is essentially of an L-shaped configuration defining a second cutout which is partially aligned with the first cutout in said vertical direction and exposes a portion of said printed circuit board upwardly in said second cutout.

13. The electrical card connector assembly as claimed in claim 10, wherein said printed circuit board is dimensioned to be large enough to essentially cover both said first contacts and said second contacts in a front-to-back direction.

14. An electrical card connector assembly comprising:

upper and lower connection units stacked with each other, each defining a card receiving cavity for receiving a corresponding electronic card therein;

a plurality of upper contacts extending within the upper connector unit;

a plurality of lower contacts extending within the lower connector unit;

both of said upper and lower connector units commonly defining a cutout at a comer of the whole assembly;

a printed circuit board having a portion, with a connection unit thereon, exposed within said cutout for electrically and mechanically connecting to another printed circuit board on which said assembly is mounted;

wherein the electrical card connector assembly further including an insulative plate sandwiched between said upper connector unit and said lower connector unit to separate the corresponding card receiving cavities under a condition that complementary interengaging devices are formed on the printed circuit board and the insulative plate for assembling;

wherein said connection unit is located at a comer of said printed circuit board, and both said first cutout and said second cutout are located at corresponding comers of said lower connector unit and said upper connector unit.

15. The electrical card connector assembly as claimed in claim 14, wherein remainders of said printed circuit board other than said exposed portion, are essentially sandwiched between the upper connector unit and aid lower connector unit.

* * * * *